US009322168B2

(12) United States Patent
Nugent

(10) Patent No.: US 9,322,168 B2
(45) Date of Patent: Apr. 26, 2016

(54) PAD FOR PREVENTING WATER DAMAGE AND STAINING OF CEILING PANELS

(71) Applicant: Todd Nugent, Little Egg Harbor, NJ (US)

(72) Inventor: Todd Nugent, Little Egg Harbor, NJ (US)

( * ) Notice: Subject to any disclaimer, the term of this patent is extended or adjusted under 35 U.S.C. 154(b) by 0 days.

(21) Appl. No.: 14/597,265

(22) Filed: Jan. 15, 2015

(65) Prior Publication Data

US 2015/0197932 A1 Jul. 16, 2015

Related U.S. Application Data

(60) Provisional application No. 61/927,643, filed on Jan. 15, 2014.

(51) Int. Cl.
*E04B 1/74* (2006.01)
*E04B 9/04* (2006.01)
*E04B 9/00* (2006.01)

(52) U.S. Cl.
CPC . *E04B 9/04* (2013.01); *E04B 9/001* (2013.01); *E04B 9/045* (2013.01); *Y10T 428/249976* (2015.04); *Y10T 428/269* (2015.01); *Y10T 428/31663* (2015.04); *Y10T 442/60* (2015.04)

(58) Field of Classification Search
CPC ..... E04B 1/70; E04B 9/001; E04B 1/88; E04B 9/04
USPC ..... 52/404.1, 506.014, 741.1, 408
See application file for complete search history.

(56) References Cited

U.S. PATENT DOCUMENTS

| | | | | |
|---|---|---|---|---|
| 4,239,031 | A * | 12/1980 | Granger | F24J 2/045 126/620 |
| 6,453,628 | B2 * | 9/2002 | Traxler | 52/169.14 |
| 6,869,680 | B2 | 3/2005 | Belmares | |
| 6,881,247 | B2 | 4/2005 | Batdorf | |
| 7,056,582 | B2 | 6/2006 | Carbo | |
| 7,220,470 | B2 * | 5/2007 | Toas et al. | 428/35.7 |
| 7,476,427 | B2 * | 1/2009 | Ruid et al. | 428/35.7 |
| 7,767,010 | B2 | 8/2010 | Curzon | |
| 8,007,886 | B2 * | 8/2011 | Tierney et al. | 428/40.1 |
| 8,362,051 | B2 | 1/2013 | Tinetti | |
| 2003/0106275 | A1 * | 6/2003 | Kennedy | F24D 3/165 52/506.02 |
| 2004/0043686 | A1 * | 3/2004 | Batdorf | 442/123 |
| 2004/0175407 | A1 | 9/2004 | McDaniel | |
| 2004/0182031 | A1 * | 9/2004 | Fay et al. | 52/404.1 |
| 2006/0053721 | A1 * | 3/2006 | Stahl | E04B 9/001 52/506.07 |
| 2006/0144012 | A1 * | 7/2006 | Manning et al. | 52/782.1 |
| 2007/0039268 | A1 * | 2/2007 | Ambrose et al. | 52/403.1 |
| 2009/0133342 | A1 * | 5/2009 | Copeland | 52/202 |

FOREIGN PATENT DOCUMENTS

| | | |
|---|---|---|
| EP | 2431429 | 3/2012 |
| WO | 2006014426 | 2/2006 |

* cited by examiner

*Primary Examiner* — Brian Glessner
*Assistant Examiner* — Paola Agudelo
(74) *Attorney, Agent, or Firm* — Gearhart Law, LLC

(57) ABSTRACT

This disclosure provides a device and a method to manage ceilings with stains caused by water condensation. The device is a pad having an insulation layer saturated with antimicrobial compound and a water proof membrane glued under the insulation layer. The pad can be cut to any size. The pad is laying freely on top of a drop ceiling panel and it may be replaced easily when needed.

18 Claims, 1 Drawing Sheet

PAD FOR PREVENTING WATER DAMAGE AND STAINING OF CEILING PANELS

PRIORITY

This application claims the priority of U.S. Ser. No. 61/927,643 filed on Jan. 15, 2014, the contents of which are fully incorporated herein by reference.

FIELD OF THE INVENTION

The invention relates to insulated ceiling panels and methods to prevent ceiling stains.

BACKGROUND OF THE INVENTION

Ceiling stains are unpleasant but very common both in residential as well as in commercial buildings, Usually ceiling stain is a brownish or gray area in the ceiling or ceiling panel. Sometimes, the stain may be due to water leak but commonly condensation of water is the cause of random ceiling stains.

Ceiling stains may be difficult to cover. Painting over the stain will most probably not help but the stain would over time show through the new paint. Changing a new panel may help temporarily, but if the reason for water condensation is not eliminated the stain will appear on the same place again.

When the condensation process is not addressed early enough there is a chance of mold or other fungal growth either on the insulation behind the ceiling panel (if there is an insulation layer) or on the ceiling panel itself. The stain on the ceiling is related to the moisture but may actually be caused by the growth.

There are various publications addressing related problems but none of them provide the solutions provided by this invention.

Canadian patent publication CA 2572586 discloses insulation paper treated with antimicrobial agent.

European patent publication EP2431429 discloses an antifungal coating that may be applied on a film that is attached to a surface, such as wooden building surface.

U.S. Pat. No. 6,869,680 discloses stainless acoustic panel, including ceiling panels. The panels are coated with thin layer of latex optionally including a chelating agent.

U.S. Pat. No. 6,881,247 discloses construction material treated with borate compounds to prevent mold and mildew growth.

U.S. Pat. No. 7,056,582 discloses a mold resistant acoustic or ceiling panel, where the panel comprises or is treated with zinc pyrithione.

U.S. Pat. No. 7,767,010 discloses a composition to be applied on building material to prevent growth of mold and mildew and on the other hand to improve the fire resistance of the material.

U.S. Pat. No. 8,362,017 discloses mold resistant wallpaper.

US patent application publication number 2004/0175407 discloses an antimicrobial coating for building material, such a ceiling panels.

Accordingly there are solutions available to coat or treat ceiling panels, solutions for antimicrobial papers and building materials treated with chemicals. However, none of these disclosures provide the benefits and advantages that the present invention provides. The most common way to address a stain on a ceiling panel is changing the panel Due to the fact that ceiling stains are very common there is a need for a simple, economic and easy device and method to prevent ceiling stains.

SUMMARY OF THE INVENTION

Accordingly, an object of the present invention is to provide pads to be applied on ceiling panels to provide insulation, prevent water leakage and simultaneously provide antimicrobial elements to prevent microbial growth.

Another object of the invention is to provide material that can be cut into any size for use in preventing ceiling stains.

Yet another object of the invention is to provide material that can be used only where needed for use in preventing ceiling stains.

Yet another object of the invention is to provide material that is easy to apply and replace when needed for use in preventing ceiling stains.

A further object of the invention is to provide a method to manage a ceiling with water condensation issues without a need to replace ceiling panels.

Yet another object of this invention is to increase the life time of ceiling panels, especially of drop panels.

It is an object of this invention to provide a pad for preventing ceiling stains, said pad comprising a water proof membrane and an insulation layer; said insulation layer being saturated with an antimicrobial agent and said insulation layer having an upper surface and a lower surface, and said water proof membrane being attached to the lower surface of the insulation layer, and the pad being installed above ceiling panel with the lower surface of the insulation layer toward the ceiling panel.

It is another object of this invention to provide a method to prevent ceiling stains comprising the steps of: a) providing a sheet of water proof membrane; b) attaching an insulation layer on the membrane preferably by gluing ; c) saturating the insulation layer with an antimicrobial agent; d) allowing the antimicrobial agent to dry; e) optionally cutting a pad of desired size from the sheet; and f) installing the product of step d) or the pad of step e) above a ceiling panel.

It is yet another object of this invention to provide a method to manage a suspended ceiling from water stains, said method comprising: a) removing a panel with water stain; b) providing a pad comprising a water proof membrane and an insulation layer; said insulation layer being saturated with an antimicrobial agent and said insulation layer having an upper surface and a lower surface, and said water proof membrane being attached to the lower surface of the insulation layer, and the pad being installed above ceiling panel with the lower surface of the insulation layer toward the ceiling panel where the pad is cut to same size as the panel; c) laying the pad on top of a new panel; d) installing the panel with a pad on top of it to replace the pad removed in step a); and e) replacing the pad when needed to prevent new stains.

DESCRIPTION OF THE PREFERRED EMBODIMENTS

The preferred embodiments of the present invention will now be described and reference is made to FIG. 1 and FIG. 2.

Figure 1:
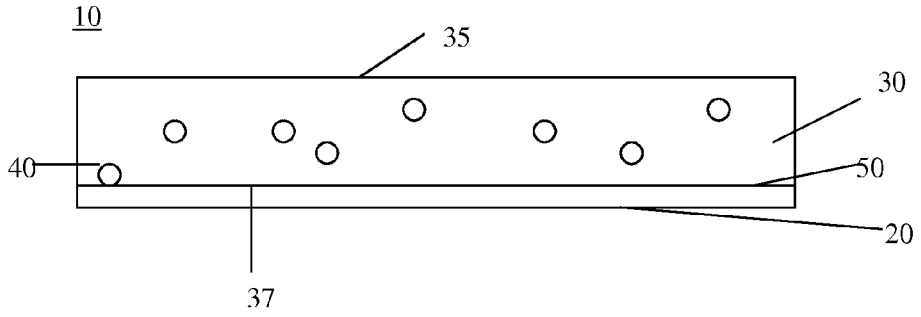
FIG. 1 shows a cross-sectional illustration of the pad according to this invention.

FIG. 1 shows the cross sectional cut of the ceiling pad 10 of this invention. The ceiling pad is formed of a water proof membrane 20, and an insulation layer 30. The insulation layer 30 has an upper surface 35 and a lower surface 37. The insulation layer 30 is concentrated with an antimicrobial compound 40. The water proof membrane 20 is attached on the insulation layer 30 preferably with a glue 50.

Figure 2:
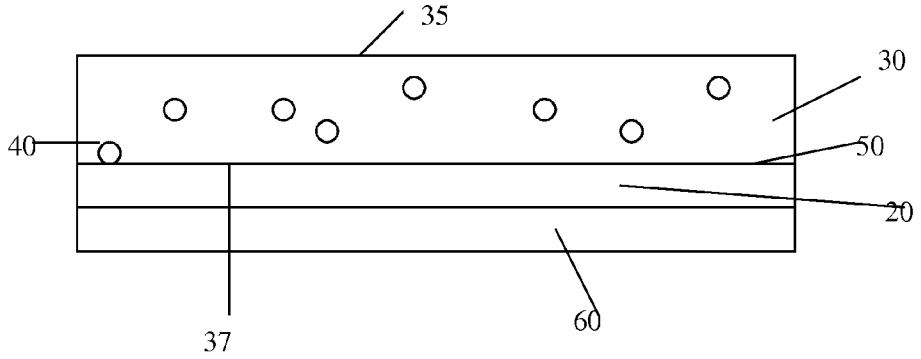
FIG. 2 shows a cross-sectional illustration of the pad according to this invention installed on a ceiling panel or tile.

FIG. 2 shows the cross sectional view of the ceiling pad installed on a ceiling panel or a tile 60. The pad is formed of a water proof membrane 20, which is glued with glue 50 on lower surface 37 of an insulation layer 30. The insulation layer is concentrated with an antimicrobial compound 40. The pad is laid on top of the ceiling element or tile 60 with the water proof membrane 20 toward the ceiling element or tile 60 and the insulation layer 30 upward toward the roof structures.

Especially useful the pad of this invention is in connection with suspended ceilings. Most preferably the pad is not attached to the panel but freely lies on top of the drop panel.

When there is water condensation above the ceiling panels the condensed water would first enter the insulation layer 30. The insulation layer according to this invention is treated with an antimicrobial agent 40. Most preferably the insulation layer is treated with an antimicrobial agent, either by spraying or by soaking to saturate the insulation layer with the antimicrobial.

According to an alternative embodiment the insulation layer is treated with the antimicrobial agent so that the lowermost part, the uppermost part or both of the insulation layer become saturated with the antimicrobial agent. This alternative embodiment provides an insulation layer with a layer of antimicrobial agent on one or both surfaces of the insulation. This alternative embodiment is practical when the insulation layer is for example of Styrofoam material.

According to a preferred embodiment the antimicrobial agent is an organosilane the structure of which makes the agent to stick on the insulation material and not be dissolved into the condensed water. The active ingredient killing the microbes, could for example octadecylaminodimethyl-trihydroxysilyl propyl or 3-trimethoxysilylpropyloctade-cyldimethyl ammonium chloride. The active ingredient may also be zinc pyrithione, but other antimicrobial active agents effective on mold and mildew are also possible. A non limiting example of a commercially available antimicrobial that may be used in this invention is BioShield 75®.

According to a preferred embodiment the active agent is non toxic, odorless, and biodegradable. The active agent may be of natural origin but may also be a synthetic compound.

When the condensed water penetrates through the insulation layer the active ingredients kill the micro-organisms thereby preventing growth of mildew or mold on the insulation layer.

Once the condensed water has penetrated through the insulation layer 30 it will hit the water proof membrane 20 glued on the lower surface of the insulation layer. This water proof membrane now prevents the water to penetrate into the ceiling panel or tile 60 and thereby the problem of ceiling stains is eliminated.

The pad is preferably freely lying on top of the ceiling panel and therefore when needed it can be easily removed and replaced with new pad.

According to an alternate embodiment the pad may be glued or otherwise attached on the ceiling panel. However, in this embodiment replacement of the pad may not be easy and replacement of the whole panel may be needed in case the pad begins to leak. However, in certain conditions such permanent pad may be a preferable solution.

The pads can be cut out from sheets provided in large dimensions. This embodiment allows the user to choose a desired size of the pad.

According to one preferred embodiment the pads are provided as sheets that are rolled and the user cuts the desired size when needed.

According to another embodiment the pads are provided in sets that include one or more pads of similar or different sizes.

According to one embodiment the pads are provided in size of standard ceiling panels.

According to one embodiment the pads are provided in sizes of 24"×24" (60.96×60.96 cm) or 24"×48" (60.96×121.92 cm).

The pad to be used may be of size of the ceiling panel, but it may be just a portion of the panel to protect a small area where water condensation otherwise tends to make stains on the ceiling panels.

According to one preferred embodiment, the pads according to this invention are manufactured by laying down the waterproof membrane, then attaching the insulation on the membrane. The insulation is preferably glued on the membrane, but other methods such as heating may also be used. The insulation layer is then saturated with the antimicrobial, which may be applied as a spray. The composition is then allowed to dry.

The manufacturing of the pads may be done by gluing water proof membrane on a insulation layer that is much larger than the pad that are actually used. Once the insulation layer has been saturated with the antimicrobial and the saturated layer is totally dry, it may be cut to smaller pads to be applied on ceiling panels. Alternatively, the waterproof membrane and the insulation layer are both cut to smaller pads before gluing them together and treating the insulation layer with the antimicrobial.

According to another preferred embodiment, the insulation layer is first treated with the antimicrobial. Once the layer is saturated or one or both of the surfaces of the layer are saturated with the antimicrobial the layer is let to dry. Once the layer is dry it will be glued on the water proof membrane. Again the cutting of pads of desired sizes may be done before or after the saturation and gluing processes.

According to a preferred embodiment the water proof membrane is breathable, thus allowing water vapor to penetrate it but not allowing liquid water to come through.

The membrane is preferably nonwoven material. A non limiting example of such material is Tyvek®-paper.

The glue used in attaching the water proof membrane on the insulation layer may be a water based adhesive.

The insulation layer may be Styrofoam, mineral fiber, fiber glass, cotton fiber, mineral wool, or any other customarily used insulation material. The insulation layer may serve as temperature as well as acoustic insulation.

The insulation layer is preferably 0.1 to 5 inches (0.25 to 12.7 cm) thick, more preferably 0.5 to 1 inches (1.27 to 2.54 cm) and most preferably about⅝ inches (1.58 cm) thick, but any feasible thickness may be used.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A pad for preventing ceiling stains, said pad comprising a water proof membrane and an insulation layer;

said insulation layer being saturated with an antimicrobial agent, and said insulation layer having an upper surface and a lower surface, said water proof membrane being attached to the lower surface of the insulation layer, and the pad being installed above a ceiling panel with the water proof membrane touching the ceiling panel, wherein the antimicrobial agent is an organosilane.

2. The pad of claim 1, wherein the water proof membrane is non woven material and it is attached on the lower surface of the insulation layer with glue.

3. The pad of claim 1, wherein the antimicrobial agent is octadecylaminodimethyl-trihydroxysilyl propyl or 3-trimethoxysilylpropyloctade-cyldimethyl ammonium chloride.

4. The pad of claim 1, wherein the insulation layer is made of fiber glass.

5. The pad of claim 4, wherein the insulation layer is 0.5 to 1 inches thick.

6. The pad of claim 5, wherein the insulation layer is ⅝ inches thick.

7. The pad of claim 1, wherein the pad is provided in dimensions larger than the ceiling panel and is capable of being cut to fit into an install location.

8. The pad of claim 7, wherein the insulation layer is fiber glass, and the pad is provided as a rolled sheet.

9. The pad of claim 1, wherein the size of the pad is 24"×24 or 48"×24".

10. The pad of claim 1, wherein the pad is touching a drop ceiling panel.

11. The pad of claim 10, wherein the pad lays freely on top of the drop panel.

12. A method to prevent ceiling stains comprising the steps of:

a) providing a sheet of water proof membrane;

b) gluing an insulation layer on the membrane;

c) saturating the insulation layer with an antimicrobial agent, wherein said antimicrobial agent is an organosilane;

d) allowing the antimicrobial agent to dry;

e) optionally cutting a desired sized pad from the sheet; and f) installing the product of step d) or pad of step e) above and touching a ceiling panel.

13. The method of claim 12, wherein the insulation layer is fiber glass layer.

14. The method of claim 12, wherein the ceiling panel is a drop panel.

15. The method of claim 12, wherein the product is touching the drop panel.

16. The method of claim 12, wherein the water proof membrane and the insulation layer are cut to a desired size after step a).

17. The method of claim 12, wherein the product of step d) is cut to a predetermined size.

18. The method of claim 17, wherein the predetermined size is the size of the drop panel.

* * * * *